US006842926B2

(12) United States Patent
Kuo

(10) Patent No.: US 6,842,926 B2
(45) Date of Patent: Jan. 18, 2005

(54) GELATINOUS CUSHION HAVING FIBEROUS BASE

(76) Inventor: Chun Fu Kuo, No. 2, Lane 332, Fong Jou Road, Shern Gan Hsiang, Taichung Hsien (TW), 429

( * ) Notice: Subject to any disclaimer, the term of this patent is extended or adjusted under 35 U.S.C. 154(b) by 0 days.

(21) Appl. No.: 10/772,637

(22) Filed: Feb. 4, 2004

(65) Prior Publication Data

US 2004/0211005 A1 Oct. 28, 2004

(30) Foreign Application Priority Data

Apr. 24, 2003 (TW) ..... 92206702 U

(51) Int. Cl.[7] ..... A47C 16/00; B32B 3/10
(52) U.S. Cl. ..... 5/655.5; 5/654; 5/909
(58) Field of Search ..... 5/655.5, 644, 654, 5/653, 652, 909, 951, 952

(56) References Cited

U.S. PATENT DOCUMENTS 3,548,420 A * 12/1970 Spence ..... 623/37
3,663,973 A * 5/1972 Spence ..... 528/15
5,113,540 A * 5/1992 Sereboff ..... 5/654
5,195,199 A * 3/1993 Sereboff ..... 5/654
5,445,858 A * 8/1995 Nwoko ..... 428/71
5,749,111 A 5/1998 Pearce ..... 5/652
6,026,527 A 2/2000 Pearce ..... 5/654
6,413,458 B1 7/2002 Pearce ..... 264/141
2003/0061663 A1 * 4/2003 Lampel ..... 5/653

* cited by examiner

*Primary Examiner*—Robert G. Santos
(74) *Attorney, Agent, or Firm*—Charles E. Baxley

(57) ABSTRACT

A gelatinous cushion includes a base member made of fibrous material, and a cushioning member attached onto the fibrous base member and made of gelatinous material for cushioning purposes, and having an outer peripheral surface and a number of orifices for cushioning purposes. An outer covering film is further applied onto the outer peripheral surface of the cushioning member, to cover the cushioning member, and to form a smooth outer surface for the cushioning member, and to prevent dirt from attaching onto the sticky cushioning member, and/or to prevent the sticky cushioning member from sticking onto various objects, such as users.

6 Claims, 5 Drawing Sheets

GELATINOUS CUSHION HAVING FIBEROUS BASE

BACKGROUND OF THE INVENTION

1. Field of the Invention

The present invention relates to a gelatinous cushion, and more particularly to a gelatinous cushion having an economized or economic fibrous base.

2. Description of the Prior Art

Various kinds of typical gelatinous cushions have been developed and comprise a number of parallel elongate columns formed from a soft, easily deformable elastic or visco-elastic cushioning media, such as gelatinous elastomer or gelatinous viscoelastomer, etc.

For example, U.S. Pat. No. 5,749,111 to Pearce, and U.S. Pat. No. 6,026,527 to Pearce disclose two of the typical gelatinous cushions having a characteristic to conform to the shape of the cushioned object while evenly distributing a supporting force across the contact area of the cushioned object and avoiding pressure peaks.

The whole typical gelatinous cushions are made of deformable elastic or visco-elastic cushioning media which is expensive, such that the products made of the expensive gelatinous cushion will also be expensive.

U.S. Pat. No. 6,413,458 to Pearce disclose a similar typical gelatinous cushion formed by molding, melting and forcing processes. However, similarly, the whole typical gelatinous cushion is also made of deformable elastic or visco-elastic cushioning media which is expensive, such that the product made of the expensive gelatinous cushion will also be expensive.

The present invention has arisen to mitigate and/or obviate the afore-described disadvantages of the conventional gelatinous cushions.

SUMMARY OF THE INVENTION

The primary objective of the present invention is to provide a gelatinous cushion including an economized or economic fibrous base having reduced quantity of deformable elastic or visco-elastic cushioning media.

In accordance with one aspect of the invention, there is provided a gelatinous cushion comprising a gelatinous cushion comprising a base member made of fibrous material, a cushioning member attached onto the base member, and made of gelatinous material for cushioning purposes, and including an outer peripheral surface formed thereon, and including a number of orifices formed therein for cushioning purposes, and an outer covering film applied onto the outer peripheral surface of the cushioning member, to cover the cushioning member, and to form a smooth outer surface for the cushioning member.

The base member includes a number of perforations formed therein. It is preferable that the base member includes a number of fibers secured together to form the perforations thereof. The base member includes an outer coating applied onto the fibers to secure the fibers together and to dorm the perforations in the base member.

The cushioning member includes a number of inner peripheral surfaces formed therein, to define the orifices of the cushioning member respectively. The outer covering film is preferably applied onto the inner peripheral surfaces of the cushioning member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
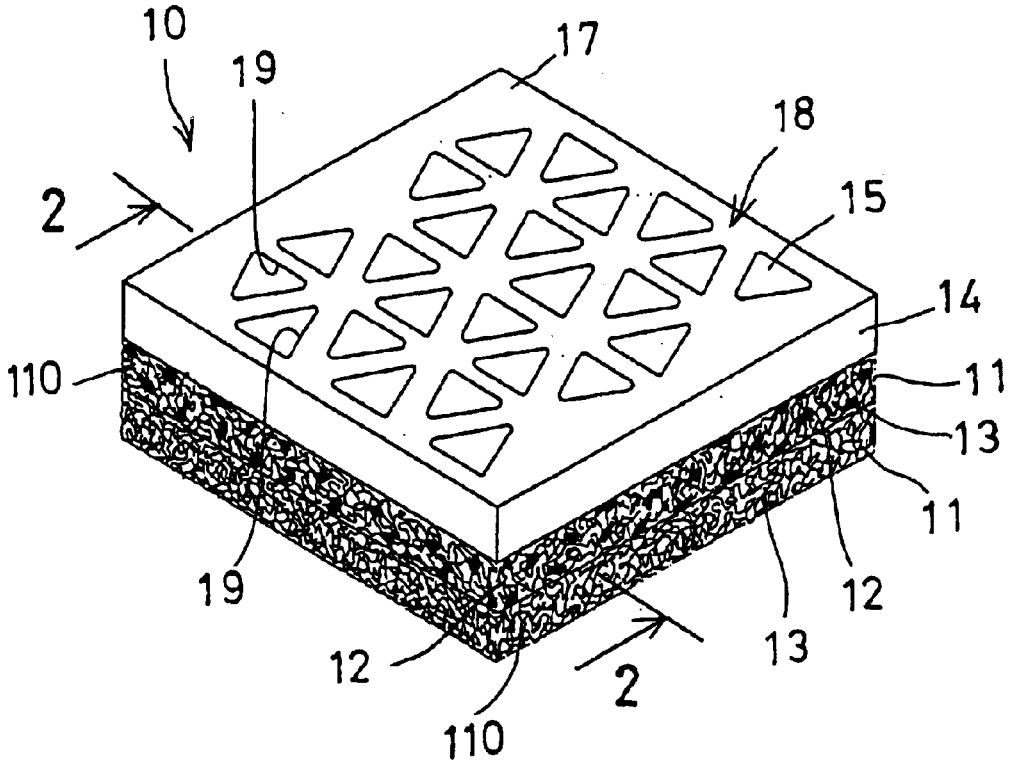
FIG. 1 is a perspective view of a gelatinous cushion in accordance with the present invention.
Figure 2:
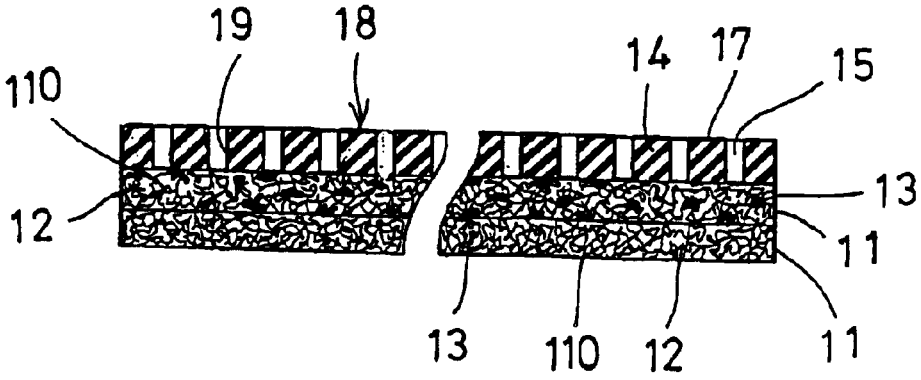
FIG. 2 is a cross sectional view taken along lines 2—2 of FIG. 1.
Figure 3:
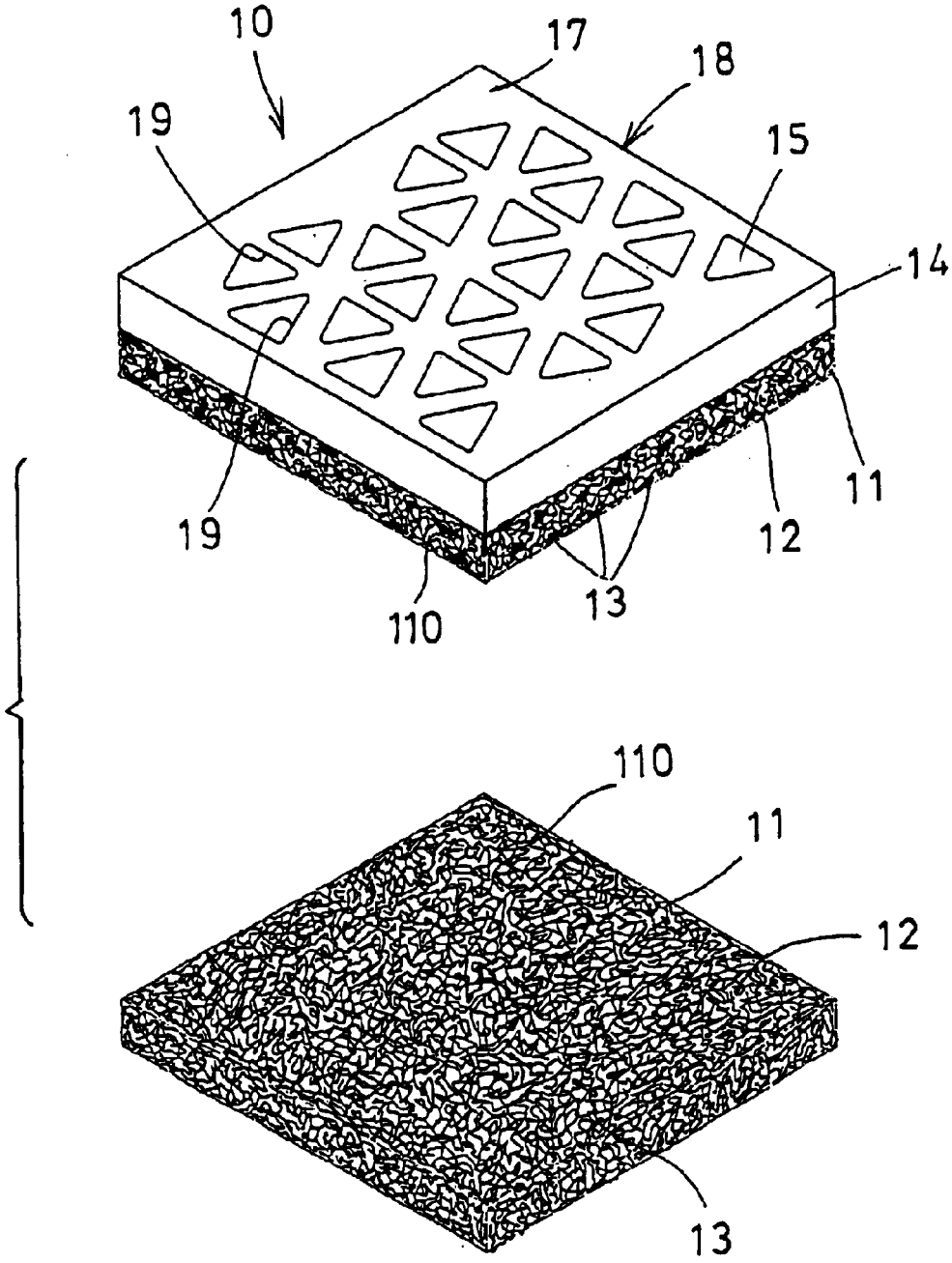
FIG. 3 is a partial exploded view of the gelatinous cushion.

Referring to the drawings, and initially to FIGS. 1–3, a gelatinous cushion 10 in accordance with the present invention comprises one or more layers of base members 11 superposed with each other and made of fiber materials 110 and each having a number of perforations 12 formed therein, for such as air circulation purposes, and a cushioning layer or member 14 attached to the base member 11, and made of a soft, easily deformable elastic or visco-elastic cushioning media, such as gel, polyurethane (PU), gelatinous elastomer or gelatinous viscoelastomer, or other synthetic materials.

The base members 11 may be made of fiber materials 110, such as natural plant fibers, wool materials, fiber glass materials, synthetic materials, or the like, and are applied with a resilient outer coating 13 of such as poly urethane (PU) materials, for adhering or securing the fiber materials 110 of the base members 11 together, and for forming or defining the perforations 12 in the base members 11, and to form the spatial and cushioning structure for the base members 11.

The elastic or visco-elastic cushioning media may normally include a sticky characteristic and may easily stuck onto various objects, such that the outer peripheral surface 18 of the cushioning member 14 may be easily covered with a layer of dirt. It is preferable that the cushioning member 14 includes a number of apertures or columns 15 formed therein and each defined by one or more inner peripheral surfaces 19.

In order to cover or shield the sticky cushioning member 14 that is made of the elastic or visco-elastic cushioning media, an outer covering film 17 is further provided and attached onto the outer peripheral surface 18 of the cushioning member 14 and/or the inner peripheral surfaces 19 of the cushioning member 14, in order to form a smooth and non-sticky outer peripheral surface 18 for the cushioning member 14.

Figure 4:
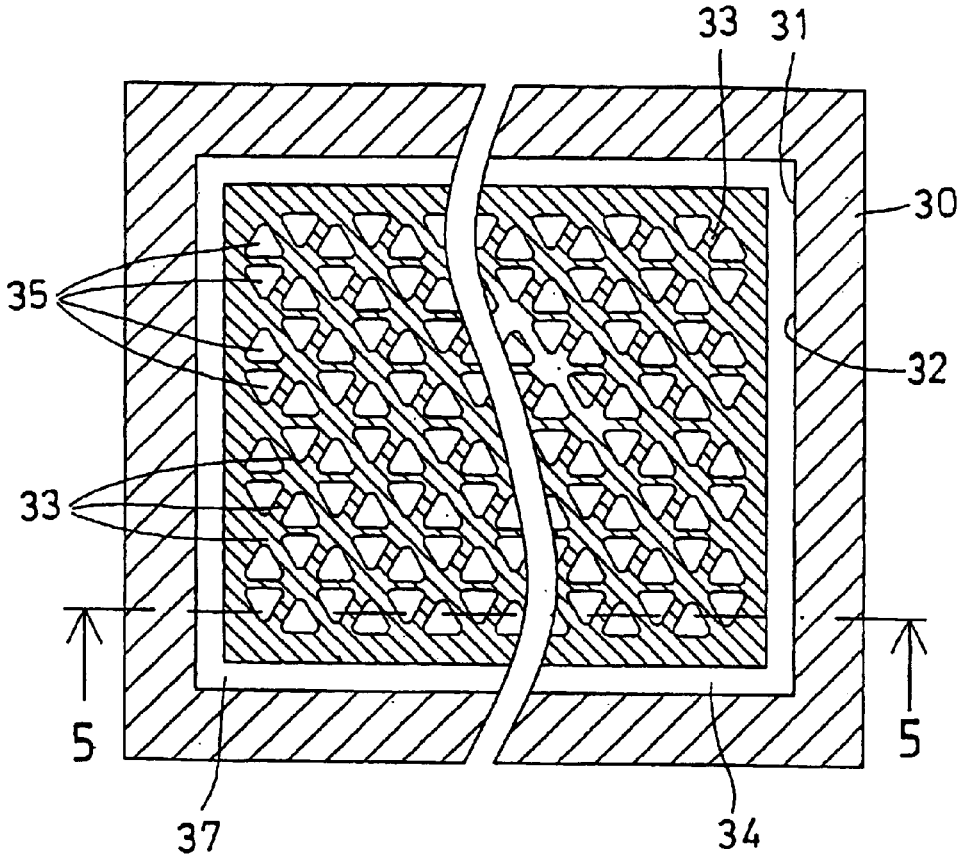
FIG. 4 is a cross sectional view of a mold device, taken along lines 4—4 of FIG. 5.
Figure 5:
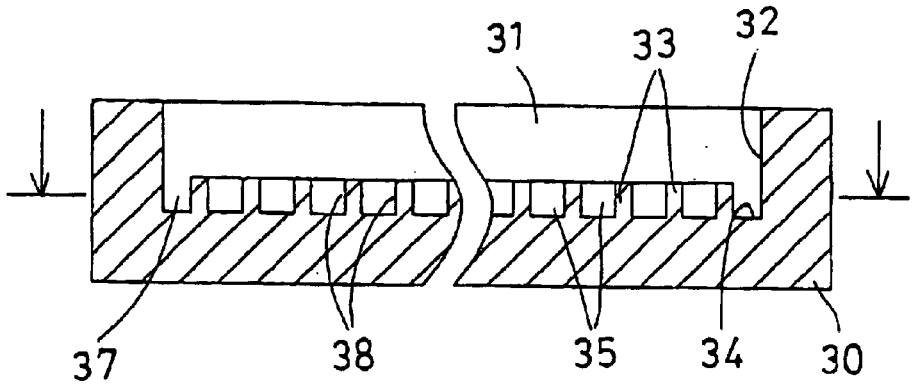
FIG. 5 is a cross sectional view taken along lines 5—5 of FIG. 4.

Referring next to FIGS. 4 and 5, illustrated is a mold device 30 for forming or manufacturing the gelatinous cushion 10. The mold device 30 includes a chamber 31 formed therein, and defined by an inner peripheral surface 32, and includes one or more partitions or ribs 33 extended from a bottom surface 34 thereof, and extended into the chamber 31 thereof, in order to form or define one or more orifices 35 therein, and to form or define a peripheral slot 37 between the ribs 33 and the inner peripheral surface 32 of the mold device 30.

The chamber 31 and/or the ribs 33 and/or the orifices 35 and/or the peripheral slot 37 of the mold device 30 may include or may be formed into a shape corresponding to that of the shapes of the products to be made, such as mattresses, shoe soles, seat cushions, pillows, etc.

Figure 6:
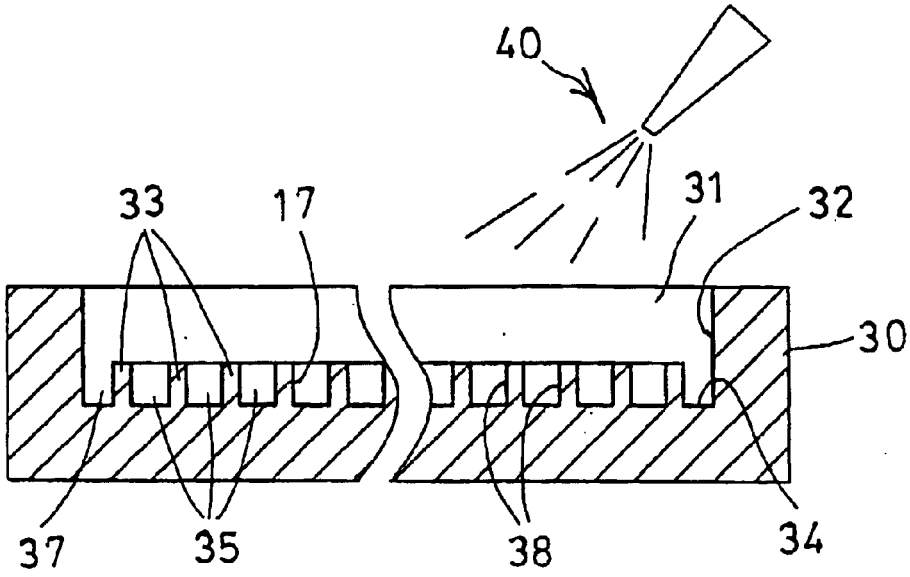
FIGS. 6, 7, 8 are cross sectional views similar to FIG. 5, illustrating the manufacturing processes for making the gelatinous cushion.
Figure 7:
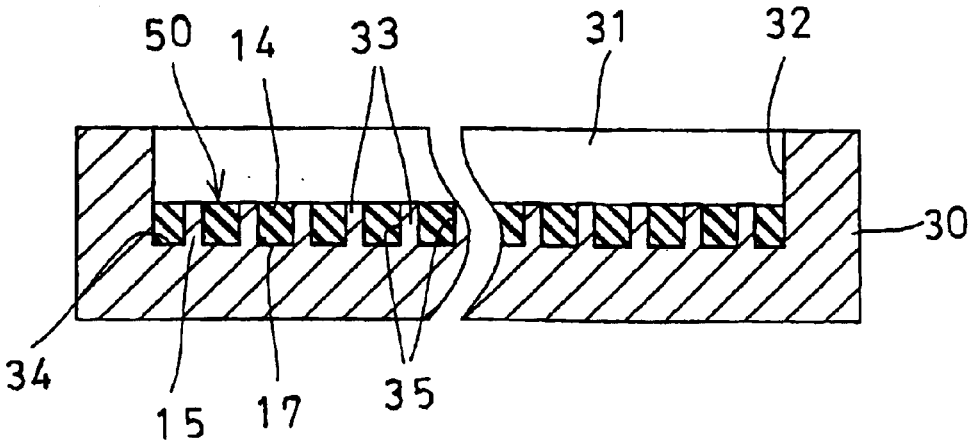
Figure 8:
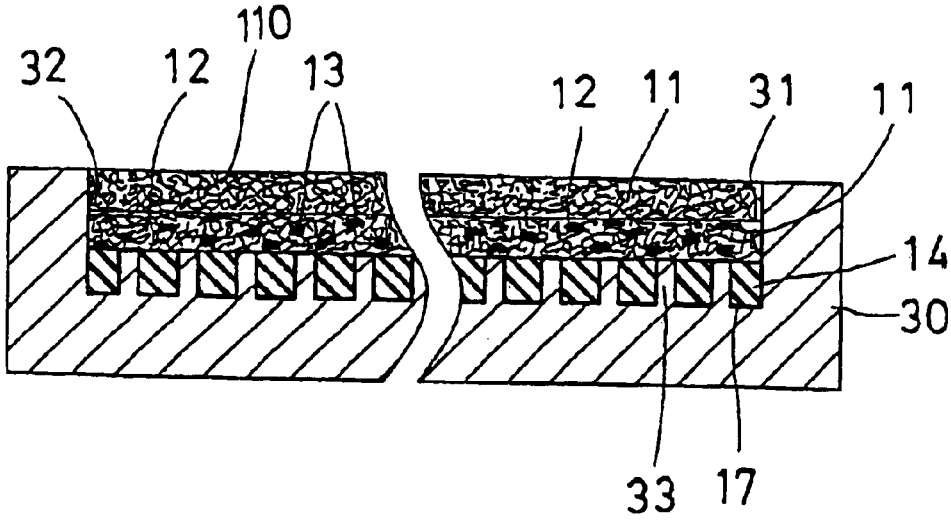

Referring next to FIGS. 6–8, illustrated are processes or procedures for forming or manufacturing the gelatinous cushion 10 with the mold device 30. For example, as shown in FIG. 6, a resilient or soft or deformable or gelatinous material 40 is sprayed or applied onto the outer peripheral surfaces 38 of the ribs 33, and onto the bottom surface 34 and/or the inner peripheral surface 32 of the mold device 30, in order to form the outer covering film 17 of the gelatinous cushion 10.

As shown in FIGS. 1–3, the gelatinous material 40 may thus be used to form the outer covering film 17 of the gelatinous cushion 10, and may be formed on the outer peripheral surface 18 and/or the inner peripheral surfaces 19 of the cushioning member 14, in order to cover or shield the sticky cushioning member 14, and to prevent dirt from attaching onto the sticky cushioning member 14, and/or to prevent the sticky cushioning member 14 from sticking onto various objects, such as users.

As shown in FIG. 7, another resilient or soft or deformable or gelatinous material 50 is then filled into the orifices 35 and/or the peripheral slot 37 of the mold device 30, to form the cushioning member 14 of the gelatinous cushion 10. As shown in FIG. 8, one or more layers of base members 11 are then disposed into the chamber 31 of the mold device 30, and secured to the cushioning member 14 to form the gelatinous cushion 10. The base members 11 may be secured to the cushioning member 14 before the resilient or soft or deformable or gelatinous material 50 is cooled or hardened.

The cushioning member 14 and the outer covering film 17 of the gelatinous cushion 10 are all manufactured with the gelatinous materials having catalysts or catalyst combinations mixed therein. The catalysts or catalyst combinations are normally used in quantities of 0.001 to 5 percent by weight, preferably of 0.05 to 3 percent by weight based on the weight of the gelatinous materials.

In which, the material for forming the outer covering film 17 of the gelatinous cushion 10 may include the catalysts or catalyst combinations having a quantity of greater percent by weight than that for the cushioning member 14 of the gelatinous cushion 10.

The base member 11 is made of fibrous materials which are cheaper or less expensive than the gelatinous materials, and forms the inner or base portion of the gelatinous cushion 10 that will not be contacted by the users. The base member 11 may include the catalysts or catalyst combinations having a quantity of greater percent by weight than that for the cushioning member 14 and the outer covering film 17 of the gelatinous cushion 10, for example. In addition, the base member 11 may also be made of waste or recycled materials.

Figure 9:
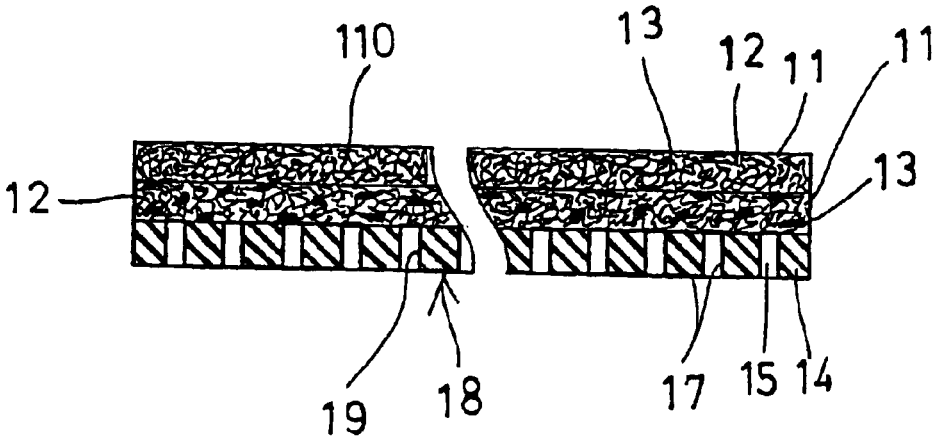
FIG. 9 is a cross sectional view, similar to FIG. 2, illustrating a final product of the gelatinous cushion.

As shown in FIG. 9, illustrated is a final product of the gelatinous cushion 10 which may include a shape corresponding to the products to be made, for comfortably supporting the users, and a cushioning member 14 attached onto the upper or the outer portion of the base member 11 (FIGS. 1 and 3), to comfortably support the users. The cushioning member 14 also includes a number of apertures or columns 15 formed therein and each defined by an inner peripheral surface 19.

The outer covering film 17 may also be applied or attached onto the outer peripheral surface 18 and/or the inner peripheral surfaces 19 of the cushioning member 14, after the base members 11 and the cushioning member 14 are secured together, to form the smooth and non-sticky outer peripheral surface 18 for the cushioning member 14, and to prevent dirt from attaching onto the sticky cushioning member 14, and/or to prevent the sticky cushioning member 14 from sticking onto various objects, such as users.

Accordingly, the gelatinous cushion includes an economized or economic fibrous base having reduced quantity of deformable elastic or visco-elastic cushioning media.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A gelatinous cushion comprising:

a base member made of fibrous material, a cushioning member attached onto said base member, and made of gelatinous material for cushioning purposes, and including an outer peripheral surface formed thereon, and including a plurality of orifices formed therein for cushioning purposes, and an outer covering film applied onto said outer peripheral surface of said cushioning member, to cover said cushioning member, and to form a smooth outer surface for said cushioning member.

2. The gelatinous cushion as claimed in claim 1, wherein said base member includes a plurality of perforations formed therein.

3. The gelatinous cushion as claimed in claim 2, wherein said base member includes a plurality of fibers secured together to form said perforations thereof.

4. The gelatinous cushion as claimed in claim 3, wherein said base member includes an outer coating applied onto said fibers to secure said fibers together and to form said perforations in said base member.

5. The gelatinous cushion as claimed in claim 1, wherein said cushioning member includes a plurality of inner peripheral surfaces formed therein, to define said orifices of said cushioning member respectively.

6. The gelatinous cushion as claimed in claim 5, wherein said outer covering film is applied onto said inner peripheral surfaces of said cushioning member.

* * * * *